US005691437A

United States Patent [19]

Main

[11] Patent Number: 5,691,437

[45] Date of Patent: Nov. 25, 1997

[54] ADHESIVE LABEL ASSEMBLY HAVING A SPECIFIC INTERNAL ADHESIVE PATTERN

[75] Inventor: George W. Main, Essex Junction, Vt.

[73] Assignee: KoBel, Inc., Milton, Vt.

[21] Appl. No.: 582,099

[22] Filed: Jan. 2, 1996

[51] Int. Cl.[6] ..... G09F 3/00

[52] U.S. Cl. ..... 428/42.1; 283/81; 428/41.8; 428/43; 428/194; 428/202

[58] Field of Search ..... 428/40.1, 42.1, 428/41.8, 41.7, 43, 194, 202; 283/81

[56] References Cited

U.S. PATENT DOCUMENTS

| | | | |
|---|---|---|---|
| 3,900,642 | 8/1975 | Michel | 428/40.1 |
| 4,127,690 | 11/1978 | Schleifenbaum | 428/40.1 |
| 4,248,919 | 2/1981 | Davis | 428/40.1 |

*Primary Examiner*—Nasser Ahmad
*Attorney, Agent, or Firm*—Thomas N. Neiman

[57] ABSTRACT

The adhesive label assembly having a specific internal adhesive pattern is designed to provide a label comprising two separate strips, each of which has an external side which contains a pre-determined printed message. The top portion of the assembly is fused together. One of the two internal sides has a specific alternating pattern of adhesive and non adhesive sections. The opposite internal side has no adhesive sections thereon and is silicone coated. A solid adhesive strip is located at one end of the internal side having the adhesive pattern which allows ease of banding together and opening of the two strips. Alternative embodiments of the assembly comprise a label having a fold at the end of the label opposite the fused end which will allow ease of attachment of the assembly. The folded portion has adhesive on its internal side to facilitate sealing. A version having a message on the internal side with the silicone coating has perforations at its upper and lower portions to facilitate removal of the internal printing. A method of producing the adhesive label assembly is also disclosed.

6 Claims, 3 Drawing Sheets

ADHESIVE LABEL ASSEMBLY HAVING A SPECIFIC INTERNAL ADHESIVE PATTERN

BACKGROUND OF THE INVENTION

The present invention is directed to a label. More particularly, the present invention is directed to an adhesive label assembly having a specific internal adhesive pattern.

Labels that are used to be positioned around products are well known in the field. Labels that have a plurality of sides upon which a pre-determined message is printed are also known in the industry.

Many useful situations exist for labels that are designed to fit around the product, whether it be a raw product such as a fruit or vegetable or processed food product that is designed to be reheated or microwaved before it is brought to the table. It is the object of this invention to describe a device which can hold multiple packages in position by means of the stabilizing effect of the strips of adhesive. Also use of the patterned adhesive reduces the level of adhesives used.

In order to attach the label around a raw product or around a package that can be placed directly into a cooking appliance, the label must be readily removable from the product. Some labels use small staples that attach them to the plastic bag holding the product, but that is not acceptable in microwave situations. The use of solid adhesive makes it very difficult to remove the label. There are disadvantages to both ways of doing it.

There are certain other disadvantages to the standard label arrangement for products such as these. For example, because the labels can use additional structure, such as the staple, parts must be ordered separately. Additionally, manufacture of those labels is a more difficult process. Just wrapping a tape around the product makes it difficult to remove and does not provide a handle for ease in gripping the product. Also, the use of a silicone liner adds to the waste products used and required to be disposed of.

Accordingly, there is a need to provide an adhesive label assembly having a specific internal adhesive pattern which overcomes the above identified deficiencies.

SUMMARY OF THE INVENTION

Particularly, it is the object of this invention to teach an adhesive label assembly having specific internal label patterns, for use in applications that require the banding together of labels or wrapping of the labels around the product, comprising a label having a plurality of strips; each of said strips having an outer side for allowing printing of labeling information to be printed thereon; said plurality of strips of said label having means for connecting each of said strips together at one end of each of said strips for forming a die cuttable tab thereon; each of said strips having an inner side; one of said inner sides of said strips having a pattern of with bands of adhesive coating; said patterns comprising first means of a band of adhesive coating and second means of a plain band having a lack of adhesive coating, said first means and said second means comprising an alternating pattern of adhesive coating and plain material; said inner side further having a base section of adhesive coating of adhesive coating for ensuring removable closure of said strips; and the other of said inner sides comprising a plain strip. Additionally, it is the object of this invention to teach an adhesive label assembly having specific internal label patterns, for use in prepared food microwave applications, comprising a label having a plurality of strips; each of said strips having an outer side for allowing printing of labeling information to be printed upon; said plurality of said strips of said label having means for connecting each of said strips together at one end of each of said strips for forming a die cuttable tab thereon; one of said strips having a longer length than the other of said strips; each of said strips having an inner side thereof; said inner side of said strips comprising the shorter length having a pattern with bands of adhesive coating; said pattern comprising first means of a band of adhesive coating and second means of a plain band having a lack of adhesive coating, said first means and said second means comprising an alternating pattern of adhesive coating and plain material; said inner side having said longer length having a folded portion at the end opposite the connecting means of said assembly; said inner side having said longer length comprising a plain cellulose material; and said inner side having a longer length having a coating of an adhesive patch located on said adhesive portion. Finally, it is the object of this invention to teach a method of producing an adhesive label assembly having a specific internal adhesive patterns, for use in the preparing of pre-determined printed labels which will be positioned around the product being promoted, comprising the steps of providing a plurality of sheets; treating the sheets to readily accept printing, if necessary; printing the outer side of one sheet; placing a layer of silicone upon the inner side of the printed sheet; printing the outer side of the second sheet; applying the adhesive in a pre-determined pattern to the inner side of said second sheet and the top portion of the inner sides of both sheets; fusing the top portion of the inner sides together forming a die cuttable tab; cutting a pre-determined design into the top portion of the assembly; and cutting the assembly into desired strips.

BRIEF DESCRIPTION OF THE DRAWINGS

Further objects and features of this invention will become more apparent by reference to the following description taken in conjunction with the following figures, in which.

DESCRIPTION OF THE PREFERRED EMBODIMENTS

Figure 2:
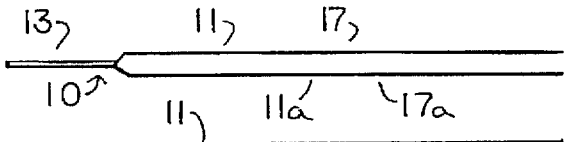
FIG. 2 illustrates the side elevational view of the label assembly.
Figure 1:
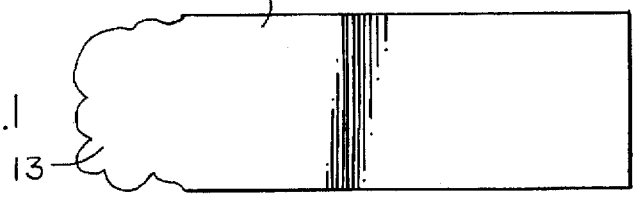
FIG. 1 illustrates the front side of the label assembly of the present invention.
Figure 3:
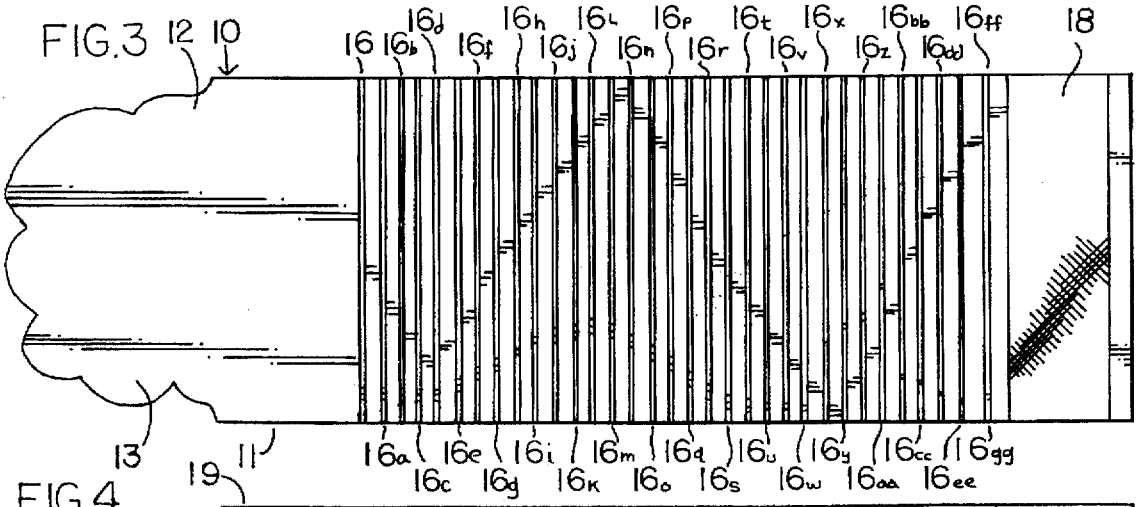
FIG. 3 is an enlarged front elevational view of the one of the inner sides of the label assembly.
Figure 4:
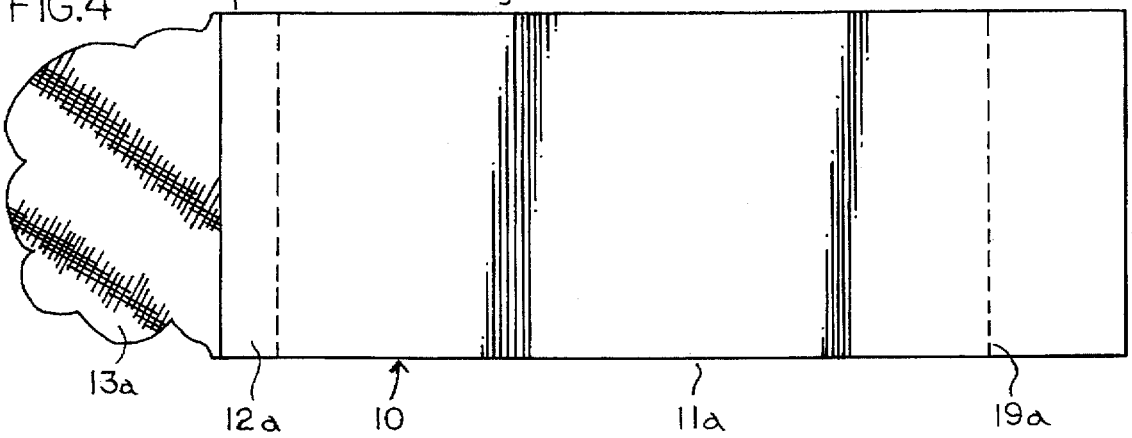
FIG. 4 is an enlarged front elevational view of the other inner side of the label assembly.

The present invention is an adhesive label structure attachable to a product and having a specific internal adhesive pattern. This label is designed to be wrapped around a product or package and be readily removable. As shown in the figures, the label assembly 10 is comprised of two strips 11 and 11*a* each of which has an inner side 12 and 12*a* and an outer side 17 and 17*a*. The inner side 12*a* of one strip 11*a* is coated with a layer of silicone in order to create a linerless construction in order to avoid the necessity to remove a throw away liner. The opposite inner side 12 contains a pattern of narrow parallel adhesive bands 16 through 16 ff that stretch across the inner side that will permit ease of attachment to the opposite strip when positioned around the product and, at the same time, ease of removal thereof and, at the same time stabilize the product in a predetermined position.

The top portion 13 and 13*a* of each of the strips 11 and 11*a* has adhesive to both inner portions and they are affixed or fused together to form a solid single piece. This top portion can incorporate a design of any shape to accommodate the wishes of the advertiser. The base section 18 of the inner side 12 of the strip with adhesive 11 has a solid section of adhesive in order to facilitate a secure, but openable area at the bottom of both strips.

The outer sides 17 and 17*a* of both strips 11 and 11*a* are prepared to receive printing. The advertising message for the label is printed thereon. An alternate embodiment for this label is designed to have printing of information on the inner side 12*a* of the strip 11*a*. In this version contains perforation 19 and 19*a* located below the fused top and the solid adhesive section area on the other strips 11 bottom portion to allow for the separation of that specific portion with the printing on the inner portion. This area could be used for the printing of discount coupons or recipes or the like and permits a lot of flexibility for the advertiser.

Figure 6:
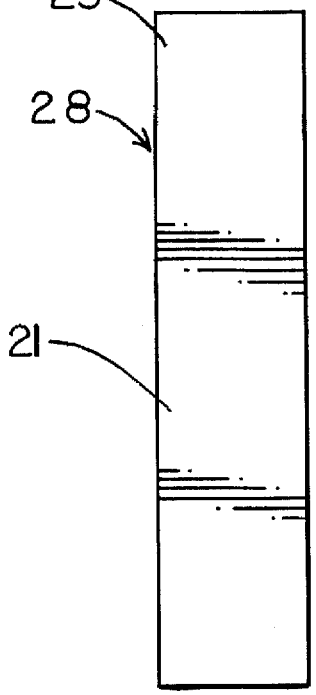
FIG. 6 is a rear elevational view thereof.
Figure 5:
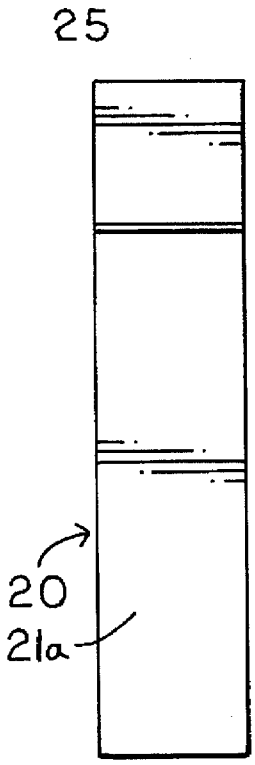
FIG. 5 is a front elevational view of an alternate embodiment of the label assembly.
Figure 7:
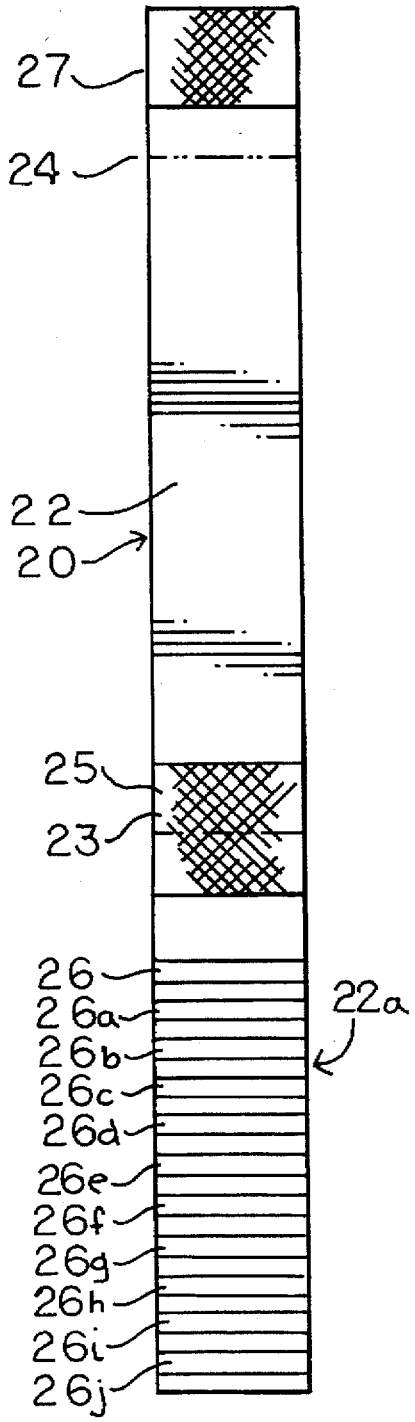
FIG. 7 is a front elevational view of the label assembly opened up showing its inner sides.
Figure 8:
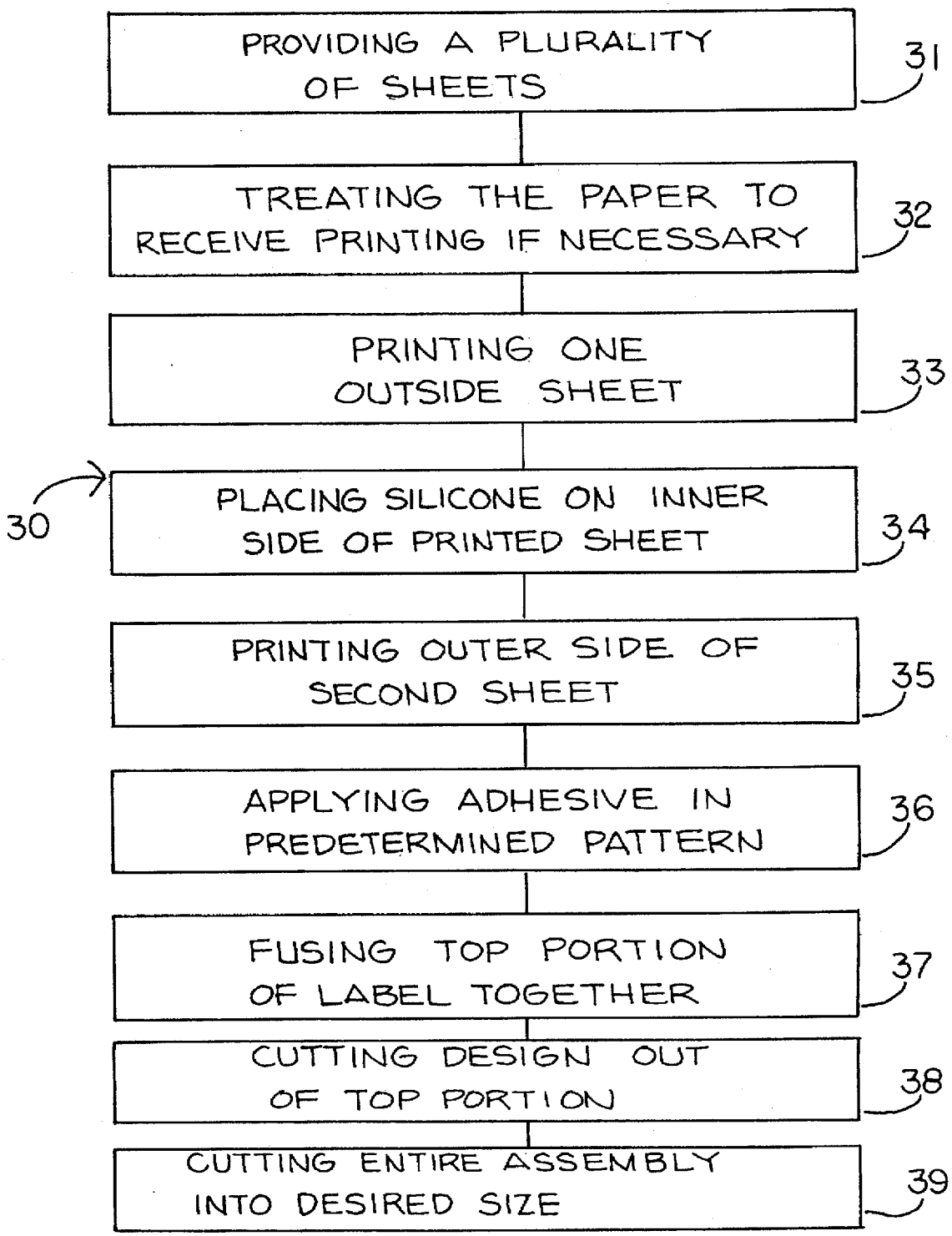
FIG. 8 is a block diagram showing the novel method of producing the label assembly.

Another embodiment, shown in FIGS. 5 through 7, shows a label 20 that is similar in many respects to the other versions. It incorporates two strips 21 and 21*a* that are fused together by locating adhesive patches 23 at the upper portion 25 of the inner sides of both strips 21 and 21*a* to form a single label. This two strips 21 and 21*a* each have inner sides 22 and 22*a*. The strip 21*a* having the inner side 22*a* with the narrow adhesive bands 26 through 26*j* is cut shorter than the side 21 with the inner side 22 that is coated with silicone. The base portion 27 of the silicone coated side 21 has an adhesive patch and is folded over at a point 24 that will equalize the length of the sides of the label when the folded portion is positioned at the base of the side 21*a*. This design is especially effective for microwave packaging applications that require cooking instructions for the packages product and, at the same time, ease of removal from the package before it is placed in the microwave.

It is also the purpose of this invention to teach the novel method of producing the adhesive label having a specific internal adhesive pattern. The method 30 comprises the steps of providing a plurality of sheets 31, preferably in a rolled form; treating the areas of the sheets that will be printed upon, if necessary 32, using a form of treatment that will roughen the surface that will receive the printing; printing an outer side of one sheet 33; placing a layer of silicone upon the inner side of the printed sheet 34; printing the outer side of the second sheet 35; applying the adhesive to the inner side of the other sheet and the top portion of the inner sides of both sheets 36, the adhesive pattern can be applied by means of slot coating a solid band or by screening a dotted band thereon; fusing the top portion of the inner sides together in order to form a die cuttable tab for the label 37; cutting a pre-determined design into the top portion of the assembly 38; and cutting the assembly into the appropriate strip size 39, that is length and width sizes. The alternate embodiments of the label would require slight modifications of the method described above. Those modifications would include the printing on the inner non adhesive side of one of the strips and cutting perforation therein. Another modification in the process would be to cut different length strips and the positioning of the adhesive patches at the base of the longer length strip.

While I have described my invention in connection with specific embodiments thereof, it is clearly to be understood that this is done only by way of example and not as a limitation to the scope of our invention as set forth in the objects thereof and in the appended claims.

I claim:

1. An adhesive label assembly having a specific internal adhesive patterns, for use in applications that require the banding together of labels or wrapping of the labels around the product, comprising:

a label having a plurality of strips;

each of said strips having an outer side for allowing printing of labeling information to be printed thereon; each of said strips having an inner side;

said plurality of strips of said label having means for connecting each of said strips together positioned at the inner side top portion of each of said strips forming a die cutable tab thereon;

only one of said inner sides of said strips having a pattern with a plurality of bands of adhesive coating;

said patterns comprising first means of a band of adhesive coating and second means of a plain band having a lack of adhesive coating, said first means and said second means comprising an alternating pattern of adhesive coating and plain material;

said inner side further having a base section of adhesive coating for insuring removable closure of said strips; and the other of said inner sides comprising a plain strip.

2. An adhesive label assembly having a specific internal adhesive patterns, according to claim 1, wherein:

said strips further comprising units of approximately uniform length.

3. An adhesive label assembly having a specific internal adhesive patterns, according to claim 1, wherein:

said connecting means for each of said strips comprises fusing said strips together; and said fusing said strips together comprises adhesive patches being positioned on said inner side top portion of each of said strips.

4. An adhesive label assembly having a specific internal adhesive patterns, according to claim 1, wherein:

said inner side of said plain strip having a coating of silicone applied thereon;

said inner side of said plain strip having pre-positioned perforations located below said top portion of said inner side and just above the base area of said inner side;

said inner side of said plain strip having a printable area located thereon.

5. An adhesive label assembly having a specific internal adhesive patterns, for use in prepared food microwave applications, comprising:

a label having a plurality of strips;

each of said strips having an outer side for allowing printing of labeling information to be printed thereon; each of said strips having an inner side;

said plurality of said strips of said label having means for connecting each of said strips together positioned at the inner side top portion of each of said strips forming a die cutable tab thereon;

one of said strips having a longer length than the other of said strips;

only said inner side of said strips comprising the shorter length having a pattern with a plurality of bands of adhesive coating;

said pattern comprising first means of a band of adhesive coating and second means of a plain band having a lack of adhesive coating, said first means and said second means comprising an alternating pattern of adhesive coating and plain material;

said inner side having said longer length having a folded portion at the end opposite the connecting means of said assembly;

said inner side having said longer length comprising a plain material; and said inner side having said longer length having a coating of an adhesive patch located on said folded portion.

6. An adhesive label assembly having a specific internal adhesive patterns, according to claim 5, wherein:

said connecting means for each of said strips comprise fusing said strips together; and said fusing said strips comprises adhesive patches being positioned at said inner side top portion of said strips.

* * * * *